United States Patent [19]

Zabielski

[11] 4,420,271

[45] * Dec. 13, 1983

[54] CENTERLINE-ATTACHED LOOSELEAF NOTEBOOK PAGE LIFTER

[76] Inventor: Ray F. Zabielski, P.O. Box 92, Roaring Springs, Tex. 79256

[ * ] Notice: The portion of the term of this patent subsequent to Feb. 15, 2000 has been disclaimed.

[21] Appl. No.: 417,887

[22] Filed: Sep. 14, 1982

Related U.S. Application Data

[63] Continuation-in-part of Ser. No. 195,758, Oct. 10, 1980, Pat. No. 4,373,825.

[51] Int. Cl.[3] ..... B24F 13/00

[52] U.S. Cl. ..... 402/80 L

[58] Field of Search ..... 402/24, 73, 80 R, 80 L

[56] References Cited

U.S. PATENT DOCUMENTS

| | | | |
|---|---|---|---|
| 791,296 | 5/1905 | Shepherd | 402/80 L X |
| 1,977,897 | 10/1934 | Schlosser et al. | 402/80 L |
| 2,090,231 | 8/1937 | Raynolds | 402/80 L X |
| 2,179,986 | 11/1939 | Trussell | 402/80 L |
| 3,191,604 | 6/1965 | Wance | 402/80 L X |
| 3,591,300 | 7/1971 | Beyer | 402/80 L |
| 3,758,219 | 9/1973 | Stasio et al. | 402/80 L |
| 4,185,934 | 1/1980 | Hodson | 402/80 L |

FOREIGN PATENT DOCUMENTS

| | | | |
|---|---|---|---|
| 75010 | 9/1893 | Fed. Rep. of Germany | 402/80 L |
| 82640 | 2/1964 | France | 402/80 L |
| 1405306 | 3/1965 | France | 402/80 L |

*Primary Examiner*—Fred Silverberg

*Attorney, Agent, or Firm*—Keil & Witherspoon

[57] ABSTRACT

A page lifting device for use with looseleaf binders containing binding rings. The leaves of the page lifter are formed from one or more rigid or flexible sheets of material, or loops of stiff wire, rotatably affixed at their inner edges to the inside of the binder at or contiguous with the centerline of the binding ring base cover. They can contain slots therein, which allow them to fit over the binder rings on closing, or be one or more rigid or flexible sheets located between the binder rings, and affixed to the inside of the binder such that the leaf or leaves envelope and lift the looseleaf pages away from the binder spine on closing.

10 Claims, 5 Drawing Figures

FIG. 1.
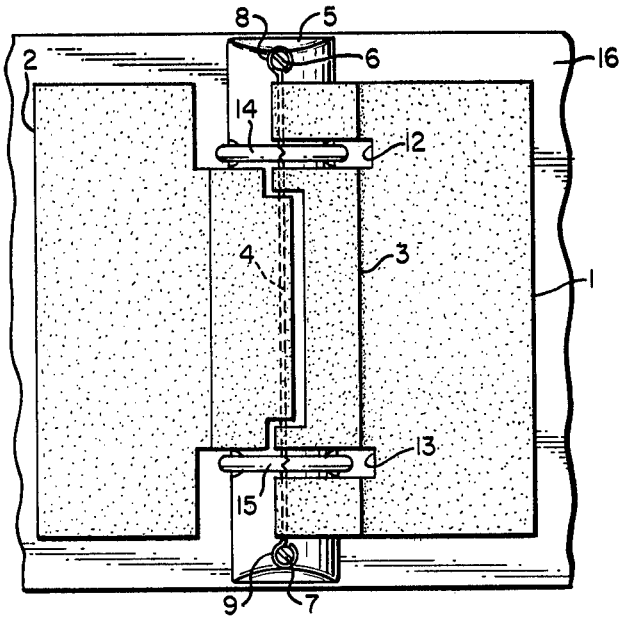
FIG. 2.
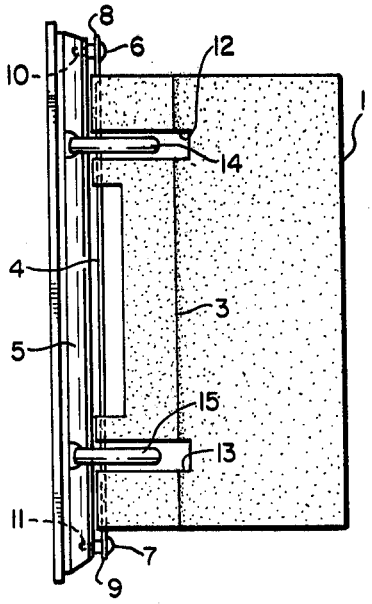
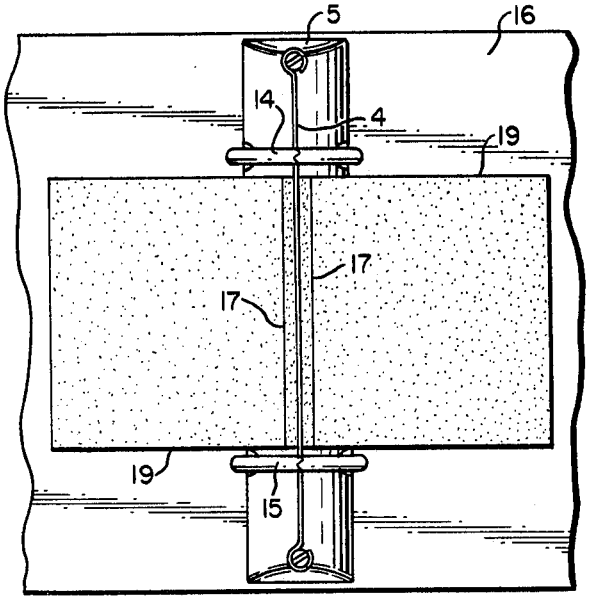
FIG. 3.
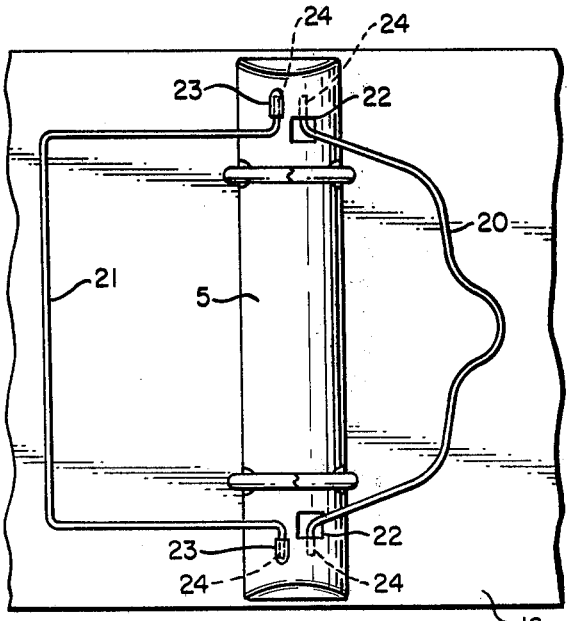
FIG. 5.
FIG. 4.
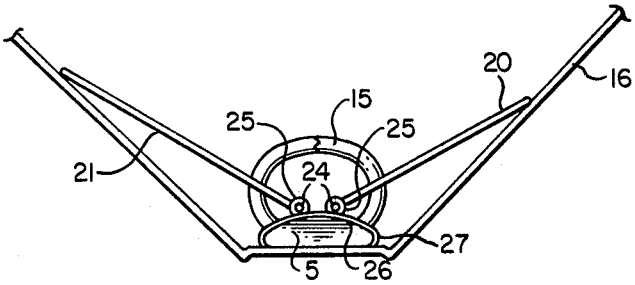

CENTERLINE-ATTACHED LOOSELEAF NOTEBOOK PAGE LIFTER

This application is a continuation-in-part of application Ser. No. 195,758, filed Oct. 10, 1980, now U.S. Pat. No. 4,373,825.

This invention relates to page lifting devices which are used to facilitate the closing of looseleaf binders. Pages at the front and back of looseleaf binders, unless lifted, remain at the base of the rings near the spine of the binder on closing. Unless these pages are manually moved to the top half of the rings, or a functional page lifitng device is used, the pages toward the front and back of the binder become torn at their holes and must be repaired and reinforced. This problem can become of a particular nuisance with frequently used catalogues and manuals.

A variety of devices are in common use which are intended to lift or protect looseleaf pages. Many of the available devices require some manual lifting of the pages on closing the binder or are of complicated construction and therefore are somewhat costly, or both.

The number of such devices in common use and the failure of many to be wholly effective without manual assistance underscores the need for a page lifting device which is both 100% effective and simple, as presently described. In addition, some embodiments of the present invention will be particularly suited to use with binders having more than the typical three rings, for which expensive custom-manufactured page lifteres are now required.

One common problem with presently used page lifters is that there is no means by which sufficient leverage is gained to force the pages in a filled binder to the top half of the ring on closing the binder. It is the solution to this problem by means of affixing the page lifter to the cover of the ring base that, in its simplicity and effectiveness, although previously unthought of, particularly distinguishes the present invention.

One object of the present invention is to provide a 100% effective page lifter which will itself not be caught at the base of the binder ring by the press of the looseleaf pages. This is accomplished either by locating the leaves of the page lifter between the binder rings, or by cutting slots at the inner edges of each leaf of sufficient size to pass over the rings without touching on closing, or by using a loop of stiff wire to form the binder leaf.

Another object of the present invention is to provide a page lifter which, on closing the binder, has sufficient force to lift the pages of a filled binder. This is accomplished by affixing the page lifter to the cover of the ring base at or contiguous with its centerline; that is, essentially, to the center of the inside of the binder. By attaching the page lifter in this way, sufficient leverage is provided on closing the binder to force the pages to the top half of the rings where they will not jam or be damaged by contact with the binder cover. Previous methods of attaching page lifters located the attachment means at or near the edges of the ring base, resulting in less leverage force than produced by the present invention and the raising of the pages occurring later in the binder closing sequences, both resulting in a greater tendency to cath the end pages between the cover and the rings.

A further object of the present invention is to offer a page lifting device which, while wholly effective, is simply and inexpensively made. The leaves of the page lifter in the present invention can be made from sheets of any relatively rigid smooth material cut or molded using conventional methods depending on the materials and the embodiments chosen. They can also be made from loops of stiff wire.

For example, in the embodiment in which a plurality of leaves are located between the rings of the binder and attached in their centers to the ring base cover, the leaves of the page lifter can be made from plastic sheet, or even stiff paper board, which can be cut to fit by the user.

It is intended that page lifters as herein described will be installed as part of the binder manufacturing process.

It is also intended that the invention as herein described will be made available to be fitted to existing binders by the user. Conventional means for attaching the page lifter to the inside of the binder by the user will be provided and may include screws, clamps, pins or adhesives.

For example, a kit including leaves of light plastic or paper board sheet could be provided such that the leaves can be cut to fit any looseleaf binder using ordinary scissors. This kit would also include a stiff wire and self-tapping screws such that the user would drill small holes at each end of the ring base cover; insert a screw in each hole; pass the wire through a tubular channel pre-formed in or attached to the inner edge of each leaf, in which slotted holes have already been cut by the user to pass over the rings on closing the binder; bend the ends of the wire around the screws forming a loop; and tighten the screws to anchor the page lifter to the ring base cover; thus installing the page lifters.

For a second example of retrofit, a kit could be provided, as described in the example above, but with the leaves as two flat sheets joined at their inner edges using plastic or fabric tape forming a narrow flexible joint. The joined leaves could then be cut horizontally into strips, across the flexible joint, to create a multiplicity of flexibly joined leaves of a proper width to fit between the rings of the subject binder. These leaves could then be attached to the binder using a stiff wire rod, as above, passing the leaves under the wire until the flexible joint lies under the wire and tightening the screws to hold the leaves in place by friction.

Other conventional mechanical means of attaching the leaves to the binder ring base cover include: welds, rivets, pins or clamps with rods; welds, rivets, screws, pins or clamps alone; and conventional hinge devices. The leaves can also be attached by flexible means such as an adhesive with cloth, plastic or other flexible materials.

In another embodiment, the leaves could be made from loops of stiff wire. Such a loop would be affixed around or between each of one or more of the binder rings, or affixed such that one loop encloses more than one ring.

In the stiff wire loop embodiment the ends of the loop are rotatably fixed to the binder, at or contiguous with the centerline thereof, by anchoring means. These anchoring means can comprise any conventional means such as raised sections of the ring base cover or indentations in the ring base cover, each having at least one opening in the face thereof through which an end of the stiff wire loop will pass. It is envisioned that the end of the loop will be bent at an angle to be parallel with the ring base cover.

The stiff wire loop embodiment may also be supplied for retrofit to existing binders having conventional anchoring means which can be fixed to the ring base cover. Examples of such conventional anchoring means are plates having or forming sockets to receive the ends of the stiff wire loop, forming a hinge and rotatably fixing the loop to the plate. These plates are attached to the ring base cover conventionally; such as with adhesive means, screws, pins, rivets or clamps, or combinations of at least two thereof. Such plates may have features such as downwardly extending sides to encounter the sides of the ring base cover and aid in holding the plate on the ring base cover. The downwardly extending sides of the plates may also be sufficiently long enough to be bent under the ring base cover, clamping the plate to the ring base cover.

BRIEF DESCRIPTION OF THE DRAWINGS

FIG. 1 is a top view of the embodiment in which leaves are held in the binder by a rod or wire passing through a tubular channel, showing the page lifter lying open in a looseleaf binder.

FIG. 2 shows the single right leaf of the page lifter viewed from the left side with the leaf being perpendicular to the spine of the looseleaf binder.

FIG. 3 is a top view of the embodiment in which the leaves are joined by flexible material, such as tape.

FIG. 4 is an end view of the binder partially closed with the page lifter of the wire loop with plate retrofit type. The plate is shown as having downwardly extending sides which conform to the shape of the ring base cover.

FIG. 5 is a top view of the stiff wire loop embodiment showing two shapes of loops and attachment by both raised sections and holes or depressions in the ring base cover.

FIG. 1 is a top view of the preferred embodiment of the page lifter lying open in a looseleaf binder. Both leaves of the page lifter are shown.

FIG. 2 shows the single right leaf 1 of the page lifter viewed from the left side with the leaf perpendicular to the spine of the looseleaf binder. Both leaves 1 and 2 would be present in the actual practice of the invention.

In the embodiment shown in FIG. 1 and FIG. 2, the inner edge 3 of the leaf is folded around the rod 4, by which the leaves are attached to the ring closing mechanism cover 5, forming an integral hinge.

The means of anchoring the rod 4 to the ring base cover 5 in this embodiment is by screws 6 and 7 which pass through loops 8 and 9 in the ends of the thin rod 4 into holes 10 and 11 in the ring base cover 5. For ordinary purposes, a stiff wire looped at each end for the rod 4 and self-tapping screws for 6 and 7 should be more than adequate. Page lifter kits can be offered for retrofit which only require the user to drill the two small holes 10 and 11 in the ring base cover 5 and form the loops 8 and 9 by bending.

In FIGS. 1 and 2 the embodiment shown of the page lifter leaf is with slots 12 and 13 cut out of the leaf providing openings which enable the page lifter leaves to move across the binder rings 14 and 15 without touching. This type of page lifter will be of greatest use with multiple ring binders, particularly where the rings are placed close together making the embodiment wherein a multiplicity of leaves placed between the binder rings, as described below, impractical.

FIG. 3 is a top view of the page lifter in the form of two leaves of material 19 joined together by tape or other highly flexible means 17 at the locus of the rod 4, located between the binder rings 14 and 15 passing under rod 4. The page lifter in FIG. 3 is held in place by conventional means; for example, by tape or other adhesive means, by mechanical means such as placing rivets in the page lifter on each side of the centerline lying under the rod 4, or merely by the friction between the rod 4 and the ring base cover 5.

The page lifter as shown in FIG. 3 located between the binder rings can be one of a multiplicity of page lifters located between many or all of the binder rings in a multiple ring looseleaf binder.

FIG. 4 is an end view of the binder partially closed with the page lifter, of the wire loop retrofit embodiment type, lifitng the pages to the top of the binder ring 15. 20 and 21 are two types of wire loops, also shown in FIG. 5, the ends of which 24 fit into sockets 25 formed in the plate 26 attached to the ring base cover 5 by conventional means, the edges 27 of which may extend downward to clamp onto the ring base cover 5.

FIG. 5 is a top view of the page lifter in the form of stiff wire loops located outside of the rings of a two ring binder. The stiff wire loop page lifters 20 and 21 are affixed to the ring base cover 5 by hinged means which, in this example, consists of holes and indentations in the ring base cover into which the end of the stiff wire loop 24, bent at a 90° angle, fits, as at 22.

Means for attaching the stiff wire loops to the ring base cover at or contiguous with the centerline of the ring base cover may also be raised sections of the ring base cover 23 having at least one opening in the upper or lower face thereof through which the end of the stiff wire loop 24 passes, rotatably anchoring the end of the stiff wire loop in the ring base cover.

The page lifters of all types shown or described will perform in a simple manner. By attaching the inner part of the page lifter to the ring base cover 5, as shown, sufficient leverage is imparted to the pages in the proper direction to lift them to the top of the binder ring on closing the biner, without manual assistance, preventing the pages from being caught at the bottom of the rings and thus preventing the pages from being torn at the ring holes.

This invention is intended to include other possible embodiments of page lifting devices which comprise rigid leaves which are attached to the ring base cover by hinged or flexible means within the scope of the following claims, and is not limited to the particular embodiments of the description and figures.

What is claimed is:

1. A page lifting device for use with a looseleaf binder having front and back covers, binding rings and a ring base cover which comprises at least one pair of stiff wire loops rotatably mounted on the top of the ring base cover by a hinge means at or contiguous with the centerline of said ring base cover, said loops being mounted perpendicular to and surrounding at least one of the binding rings and being of sufficient height to freely pass over the binding rings; whereby on closing the looseleaf binder the outermost parts of said loops encounter the inside surfaces of the looseleaf binder's front and back covers, forcing said loops toward the center of said binder and thus forcing the sides of said loops to encounter the bottom edges of any pages contained in said binder, thereby forcing said pages to rise on the binding rings away from the ring base cover toward the uppermost part of said binding rings preventing the pages from being caught between the binding rings and the inside surfaces of the looseleaf binder's front and back covers; wherein the hinge means by which the stiff wire loops are attached to the top of the ring base cover comprises the ring base cover having at least two raised sections formed in the surface thereof, at least one end face of each raised section having a means for receiving the end of at least one of said pair of stiff wire loops, and each of said pair of stiff wire loops having their ends angled to lie parallel to the ring base cover; the raised sections in ring base cover and the means for receiving the end of at least one stiff wire loop being located and being of sufficient size to allow the angled ends of the stiff wire loops to be placed therein, rotatably attaching the stiff wire loops to the ring base cover.

2. A page lifting device as recited in claim 1 wherein the means for receiving the end of at least one stiff wire loop comprises a socket.

3. A page lifting device as recited in claim 1 wherein the means for receiving the end of said at least one stiff wire loop comprises at least one opening formed in at least one face thereof.

4. A page lifting device for use with a looseleaf binder having front and back covers, binding rings and a ring base cover which comprises at least one pair of stiff wire loops rotatably mounted on the top of the ring base cover by a hinge means at or contiguous with the centerline of said ring base cover, said loops being mounted perpendicular to and surrounding at least one of the binding rings and being of sufficient height to freely pass over the binding rings; whereby on closing the looseleaf binder the outermost parts of said loops encounter the inside sufaces of the looseleaf binder's front and back covers, forcing said loops toward the center of said binder and thus forcing the sides of said loops to encounter the bottom edges of any pages contained in said binder, thereby forcing said pages to rise on the binding rings away from the ring base cover toward the uppermost part of said binding rings preventing the pages from being caught between the binding rings and the inside surfaces of the looseleaf binder's front and back covers; wherein the hinge means by which the stiff wire loops are attached to the top of the ring base cover comprises at least one plate having means thereon to receive and rotatably fix the ends of at least two stiff wire loops to said plate; said plate being attached to the ring base cover.

5. A page lifting device as recited in claim 4, wherein the means for receiving and rotatably fixing the ends of at least two stiff wire loops to said plate comprises at least one socket formed on said plate.

6. A page lifting device as recited in claim 4, wherein the means for receiving and rotatably fixing the ends of at least two stiff wire loops to said plate comprises at least one loop of material on said plate, the opening being parallel with said ring base cover.

7. A page lifting device as recited in claim 4, wherein the means for receiving and rotatably fixing the ends of at least two stiff wire loops to said plate comprises at least one raised section of said plate forming a socket to receive the ends of said stiff wire loops.

8. A page lifting device as recited in claim 4, wherein the means for attaching said plate to the ring base cover comprises one or more means chosen from the group consisting of adhesive means, clamp means, screw, rivet, and pin.

9. A page lifting device for use with a looseleaf binder having front and back covers, binding rings and a ring base cover, which comprises at least one pair of leaves of rigid material connected at their inner edges by flexible material, the leaves being sufficiently narrow to fit between the binding rings; a rod of a length greater than said leaves; and an attachment means by which each end of said rod is fixed to the top of the ring base cover at the centerline thereof; wherein said pair of rigid leaves, connected at their inner edges by flexible material, is located between two adjacent binding rings with the flexible material connection located at or contiguous with the centerline of the ring base cover and held in place by the rod.

10. A page lifting device as recited in claim 9, wherein the rod comprises a stiff wire rod and the attachment means is chosen from the group consisting of screws, bolts, pins and rivets.

* * * * *